United States Patent [19]

Miller

[11] 4,275,576

[45] Jun. 30, 1981

[54] COMBINATION LOCK FOR SAFE DOORS AND THE LIKE

[75] Inventor: Harry C. Miller, Nicholasville, Ky.

[73] Assignee: Sargent & Greenleaf, Inc., Nicholasville, Ky.

[21] Appl. No.: 100,656

[22] Filed: Dec. 5, 1979

[51] Int. Cl.[3] ..... E05B 15/12; E05B 37/08

[52] U.S. Cl. ..... 70/303 A; 70/322

[58] Field of Search ..... 70/321, 322, 303 A, 70/303 R, 302, 333

[56] References Cited

U.S. PATENT DOCUMENTS

| | | | |
|---|---|---|---|
| 2,792,703 | 5/1957 | Murray | 70/303 A |
| 3,045,467 | 7/1962 | Herlong | 70/322 |
| 3,391,556 | 7/1968 | Schull | 70/303 R |

*Primary Examiner*—Robert L. Wolfe

*Attorney, Agent, or Firm*—Mason, Fenwick & Lawrence

[57] ABSTRACT

A combination lock for bank vaults, safes and the like, including a pack of peripherally gated tumbler wheels loosely journaled for rotation on a tumbler post about a common axis in the lock case, a peripherally gated rotatable driving cam positioned by a manually operable dial and knob member to angularly adjust the tumbler wheels through a lost motion coupling to an opening combination for the lock, and a fence lever having a pivot connection at one end to a slidable bolt for movement arcuately between raised and lowered positions relative to the peripheries of the driving cam and tumblers. The fence lever has an upwardly arching body and a fence portion defining a foot formation projecting from the arched portion having a downwardly facing recess spanning most of its lower end portion and an elongated unitary contact bar member pivotally seated therein to normally bear on the driving cam periphery.

10 Claims, 7 Drawing Figures

Fig-1
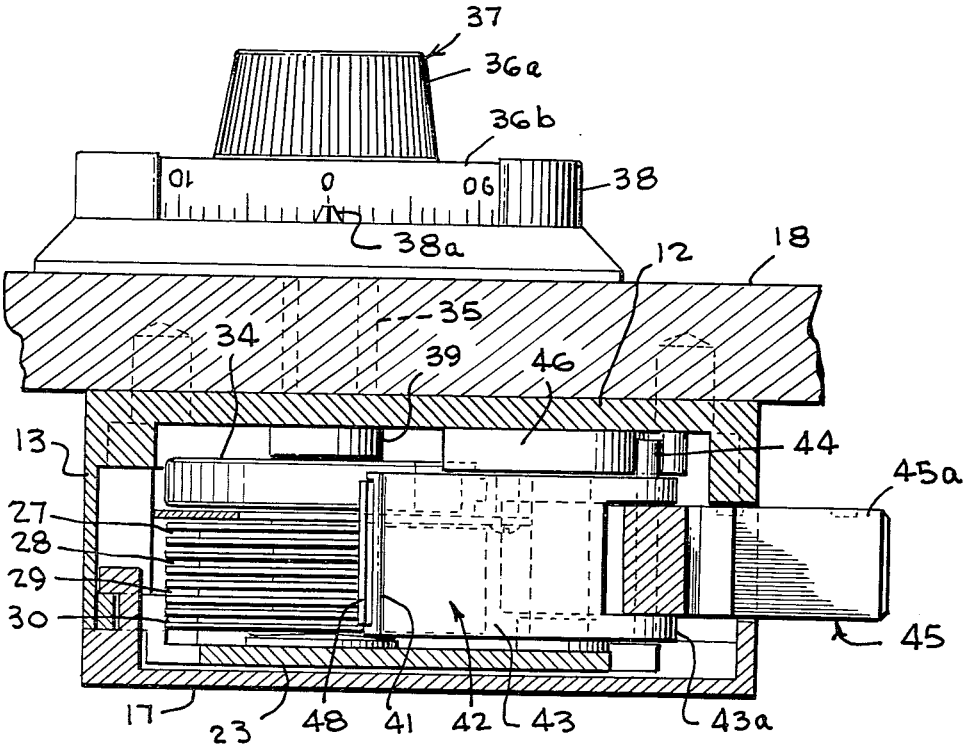
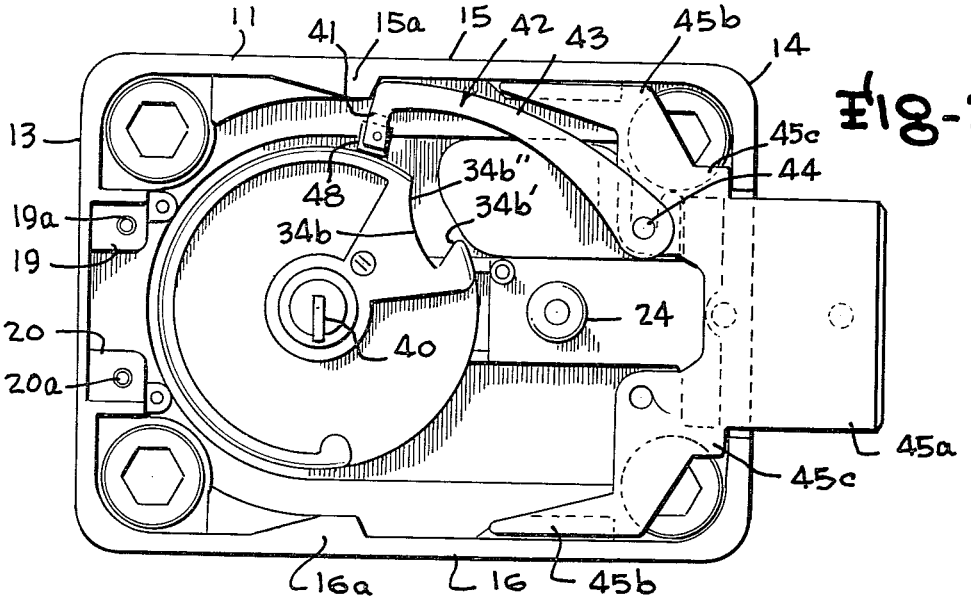
Fig-2

COMBINATION LOCK FOR SAFE DOORS AND THE LIKE

BACKGROUND AND OBJECTS OF THE INVENTION

The present invention relates in general to combination locks, and more particularly to combination locks especially adapted for use on safe doors and the like operated by a rotatable dial and having an integrally unitary arcuately curved bar-like pivoted fence lever of uniform width throughout terminating in a depending fence forming foot spanning the perimeters of the stack of tumbler wheels and drive cam, and provided with means for resisting surreptitious or unauthorized detection of the combination by manipulation techniques.

Conventional locks of the class known as combination locks usually comprise three tumbler wheels which are loosely journalled in coaxial longitudinally spaced relation for rotation within the lock case on a tubular arbor or tumbler post projecting inwardly of the casing from the front wall of the case. The lock dial, which usually has one hundred peripheral calibration marks thereon, is affixed to a dial spindle which extends through a central bore through the tumbler post and through the front wall of the lock case and the door on which it is mounted, and a disk-like cam is keyed or otherwise fastened to the rearmost end of the dial spindle and is arranged coaxially with and spaced immediately rearwardly from the stack or group of tumbler wheels. The drive pin projects forwardly from the drive cam and has a lost motion connection through a conventional fly with the rearmost tumbler wheel to drive the tumbler wheel circumferentially in selected relation to the drive cam. A similar lost motion connection is provided between each of the successive tumbler wheels so that each of the tumbler wheels may be driven upon selecteed rotation of the drive cam. Each of the tumbler wheels and the drive cam are provided with a peripheral notch or gate at a selected radial position on the drive cam and tumbler wheels.

A fence lever is pivotally connected at one end to a reciprocative bolt slidably supported in the lock case and is provided with a formation at its free end which is designed to ride upon the drive cam periphery. In many of such combination locks, the fence lever has a bar or fence member projecting laterally therefrom in overlying relation with the tumbler peripheries of the tumbler wheels. In other locks especially designed for heavy safe door installations and the like, the fence lever, instead of being a relatively thin lever formed from metal strapping or plate material, is formed as a relatively massive integral unitary curved bar-like fence member whose width corresponds substantially to the axial dimension of the stack of tumbler wheels and driving cam and terminates at its free end in a downwardly extending or depending integral unitary foot formation defining a fence portion which corresponds both to the fence lever nose and the fence member of the alternative form described above. In either case, the position of the fence in relation to the length of the fence lever nose, or the location of the lower fence forming surface of the portion of the foot formation overlying the tumbler peripheries relative to the portion of the lower foot formation surface overlying and engaging the periphery of the driving cam are such that the fence portion confronting the tumbler peripheries is spaced slightly from the tumbler peripheries when the portion riding on the driving cam periphery bears on the ungated portions of the latter.

In such combination locks, when the tumbler wheel gatings are out of registry with the fence or the fence bar portions of the fence lever foot, and the dial is turned to the proper position to dispose the drive cam gating below the fence lever nose or the corresponding portion of the fence lever foot, the latter will drop slightly into the drive cam gate until the fence or the other portions of the foot formation bear upon the tumbler peripheries. The rotation of the dial through small arcs in opposite directions from this position will bring portions of the drive cam gate into contact with the fence lever nose or corresponding portion of the fence lever foot formation. These points at which the fence lever nose or foot contacts these opposite surfaces of the entrance to the drive cam gate are known as left and right contact points of the fence lever and may be detected by coordination of the senses of touch and sight by the person manipulating the dial or by highly accurate measuring instruments. A variation in the relation and "feel" of these contact points or the measured distance between them occurs when one of the tumbler gates is positioned beneath the fence or the corresponding portion of the fence lever foot, which is distinguishable from the relation and "feel" or measure of these contact points when all of the tumbler gatings are out of registry with the fence or fence lever foot.

Various modifications in combination lock structure have heretofore been resorted to in an effort to defeat detection of the lock combination in this manner. Among these is the lock structure disclosed in prior U.S. Pat. Nos. 2,575,674; 2,807,954; and 3,339,383 to Harry C. Miller or to Harry C. Miller and others, wherein various types of guard or shielding mechanisms are mounted on the rear face of the drive cam to normally overlap and close the driving cam gate to form a smooth continuation of the drive cam periphery for supporting the fence lever nose when the drive cam gate is in registry with the fence lever nose. Means are provided to limit angular movement of the dial and dial spindle when the guard or shielding mechanism is moved to a position exposing the drive cam gate to receive the fence lever nose and allow the fence lever to contact the tumbler peripheries, to thereby prevent detection of contact points for the fence lever nose. The present invention, however, is directed to improvement of security against unauthorized detection of the opening combination for combination locks of the type wherein the fence lever nose or corresponding portion of the fence lever continuously engages the periphery of the driving cam except when the driving cam gate registers with the fence lever nose or foot portion, and wherein the incorporation of guard or shielding means to normally close the driving cam gate is unsuitable.

It has been previously proposed in U.S. Pat. Nos. 117,478 and 299,695 to Stockwell to provide eccentric rollers in the fence and fence lever nose portion of a combination lock wherein the fence lever is a relatively thin pivoted plate-like member having a fence formation projecting laterally therefrom, and wherein the fence portion and the fence lever nose portion are each provided with eccentric rollers to continuously engage the peripheries of each of the driving cam and tumbler wheels so that when one exerts pressure on the bolt to which the fence lever is directly connected to continuously strain the fence lever nose and fence portions against the driving cam and tumbler wheel peripheries, one cannot obtain satisfactory "micrometric" readings or measurements from the spindle to reliably detect the combination of the lock. However, these early proposals to improve security of combination locks did not provide the protection against surreptitious detection of the lock combination desired to be achieved in locks of the type to which the safe door combination lock construction of the present invention is directed.

An object of the present invention, therefore, is the provision of combination locks especially adapted for safe doors and the like having a massive fence lever member which is highly resistant to deformation or attack provided as an integral unitary lever with a depending foot formation at the free end thereof opposite the pivoted end of the lever member forming the fence to coact with both the peripheries of the stack of tumbler wheels and the periphery of the driving cam to prevent movement of the bolt to which the fence lever is pivoted to retracted position when the driving cam and tumblers are adjusted to the proper unlocking combination positions and to restrain the bolt against movement from projected, locked position when the tumblers and driving cam are not properly aligned in accordance with the opening combination, and having randomly movable contact means incorporated in the portion of the fence lever foot formation confronting the driving cam periphery to bear on the latter and prevent detection of contact points with the driving cam gate with sufficient accuracy to detect the combination of the lock.

Another object of the present invention is the provision of a combination lock of the type described in the immediately preceeding paragraph, wherein a randomly displaceable contact bar member is incorporated in the foot portion of the fence lever member forming the engagement surface portion of the latter for contact with the peripheries of the tumblers and the driving cam to effect random variations in the interengagement charcteristics of the fence lever and driving cam and tumber wheels and thus resist reliable surreptitious or unauthorized detection of the opening combination for the lock.

Other objects, advantages and capabilities of the present invention will become apparent from the following detailed description, taken in conjunction with the accompanying drawings illustrating preferred embodiments of the invention.

BRIEF DESCRIPTION OF THE FIGURES

FIG. 1 is a horizontal section view through the combination lock case of the present invention mounted on a safe door, with the safe door shown in fragmentary elevation and the dial and knob member an shielding dial ring shown in top elevation assembled therewith, taken substantially along the section plane indicated at 1—1 in FIG. 2;

FIG. 2 is a rear elevation of the safe door combination lock, with the rear cover removed, showing the lock in locked condition with the fence lever member resting on the tumbler wheels and driving cam;

DETAILED DESCRIPTION OF A PREFERRED EMBODIMENT

Figure 3:
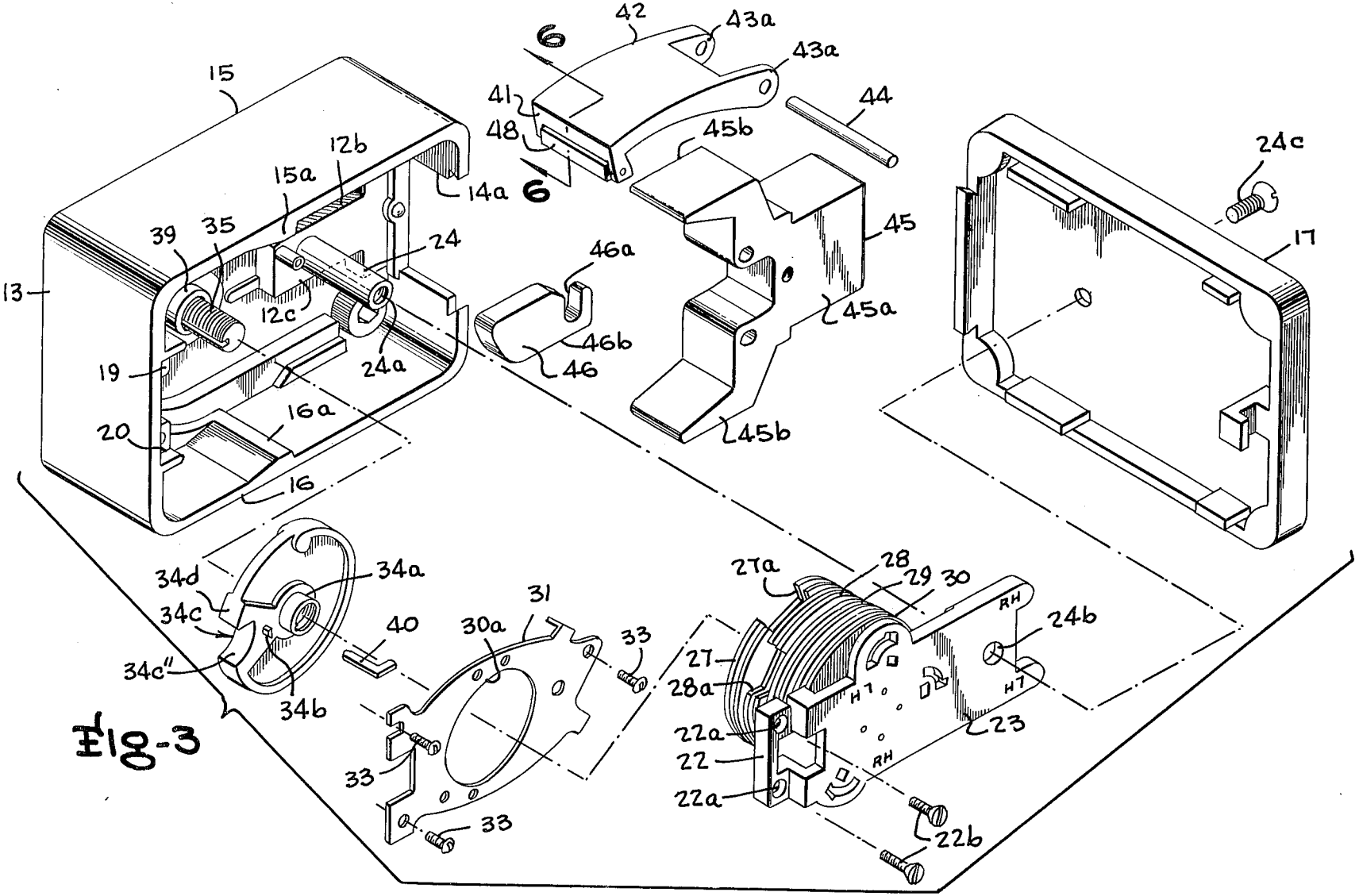
FIG. 3 is a rear exploded perspective view of the dial operated safe door combination lock.
Figure 4:
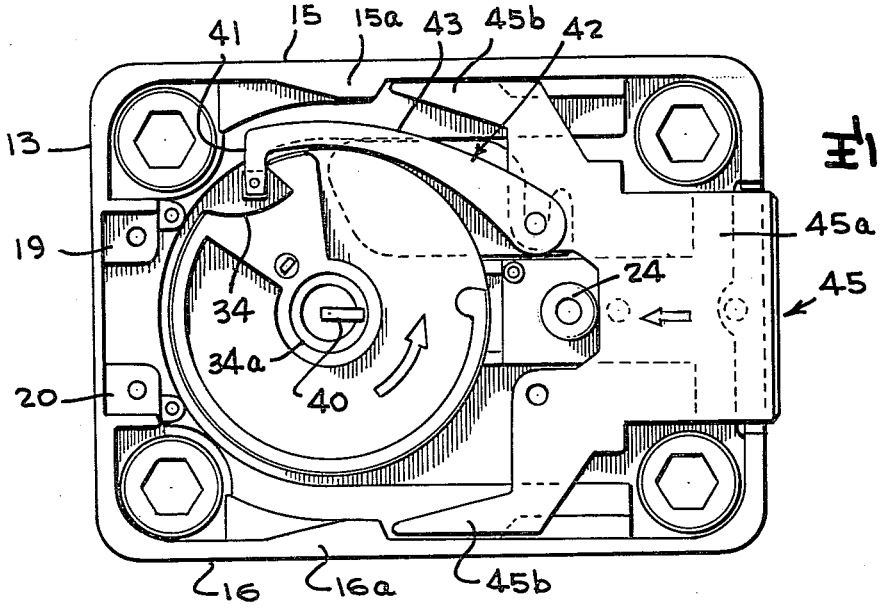
FIG. 4 is a rear elevation view similar to FIG. 2, showing the lock in unlocked condition.

Referring to the drawings, wherein like reference characters designate corresponding parts throughout the several figures, there is illustrated a dial operated combination lock mechanism especially adapted for safe doors and the like, which is generally indicated by the reference character 10, and which comprises a substantially rectangular lock case 11 having a front wall 12, rearwardly projecting end walls 13,14 and top and bottom horizontal walls 15,16 defining a mechanism chamber therebetween, which is rearwardly closed by a generally rectangular cover plate 17. The lock case or housing 11 may be mounted against inner surface of a bank vault or safe door or other closure, generally indicated at 18 in the conventional manner, as by mounting screws or bolts extending through screw holes near the corners of the lock case and into the supporting door. A pair of mounting posts 19,20 integrally formed along the end wall 13 of the lock case 11 project rearwardly from the front wall 12 to a location near the rear cover, defining abutment surfaces interrupted by tapped sockets *19a,20a*, adapted to abut and locate an apertured mounting flange 22 at the left hand end of the tumbler wheel stack supporting plate 23 as viewed in FIGS. 2 and 3. The mounting flange portion 22 of the wheel-pack supporting plate 23 is provided with countersunk screw opening *22a* to receive the mounting screws *22b* to the tapped sockets *19a,20a* to fix the flange portion 22 of the wheel-pack supporting plate 23 against the rear shoulders or walls of the mounting posts 19,20. A third mounting post 24, which is cylindrical in configuration in the illustrated embodiment, extends integrally rearwardly from the front wall 12 of the case 11 and is also provided with a tapped or threaded socket *24a* and a rear abutment surface to abut and support the opposite end portion of the wheel-pack supporting plate 23 surrounding its countersunk mounting screw hole *24b* which receives the mounting screw *24c* extending through a hole in the rear cover plate 17.

The tumbler wheel pack, generally indicated by the reference character 26, is of conventional construction, which in the illustrated embodiment is made up of four conventional changeable coaxial tumbler wheels, indicated at 27, 28, 29 and 30, each having, for example, an outer gated annular rim portion, typically formed of two thin annular plates, and an inner serrated periphery hub, for example of the general type illustrated in prior Weber U.S. Pat. No. 1,484,692 or a plastic counterpart as shown in Paul U.S. Pat. No. 3,254,519, each including a latch lever or similarly functioning mechanism in the rim portion of each tumbler wheel, for releasably interlocking the rim portion with its respective hub portion, and releasable by a change lever of typical construction activating a change key operated cam or similar mechanism to release the latch lever from the hub serrations or relock the same. Each of the tumbler wheels 27–30 have a circular periphery, in the illustrated embodiment, interrupted at one angular position by an outwardly opening generally rectangular gate or recess, as shown at *27a* and *28a*, to receive the foot end portion of a fence lever, as later described, when the proper combination has been dialed.

In one satisfactory example, each of the tumbler wheels 27–30 has a drive pin of conventional construction projecting rearwardly therefrom to engage a shoulder formation on a fly associated with the next rearwardly adjacent tumbler wheel, movable through a selected arc by rotatably supporting the same in a recess in the associated tumbler wheel, to provide the usual lost motion connection between successive tumbler wheels, all as shown and described in earlier U.S. Pat. Nos. 3,968,667 or 3,339,383. The hubs of the tumbler wheels are loosely journaled for rotation on an integral tubular cylindrical post in the usual manner fixed to and projecting forwardly from the wheel pack supporting plate 23. The tumbler wheel supporting post is typically provided with diametrically opposite grooves extending parallel to the axis of the post along the periphery to receive lugs extending inwardly from annular washers interposed between each successive pair of tumbler wheels, and the entire pack of tumbler wheels is releasably retained on the tumbler post by a spiral lock spring or washer, in well-known fashion, inserted in an annular groove near the forward-most end of the tumbler post and bearing against the surface of the hub for the rear-most tumbler wheel 27 immediately bounding the center opening therein. Typically, a spacer plate, as indicated at 31 having a center opening 31*a* which is slighly larger in diameter than the path of the drive pin on the driving cam, is removably supported on mounting posts, one of which is indicated at 32, projecting rearwardly from the front wall 12 of the lock case 11, fixed by mounting screws 33, to lie immediately forwardly of the forward-most tumbler wheel 27.

Forwardly of the spacer plate 31 is a driving cam 34 having a threaded hole in the center thereof, indicated at 34*a*, to permit it to be threaded onto the threaded spindle 35 of the knob and dial assembly, formed of a knob portion 36*c* and cylindrical larger diameter dial portion 36*b* of an integral knob and dial member 37, fixed to the forward end of a rotatable spindle 35 which extends through a hole in the safe door or other mounting wall 18 and through a corresponding diameter hole in the front wall 12 of the lock case and through the center bore of the spindle boss formation 39 projecting rearwardly a short distance from the front wall 12 of the lock case. The dial 36*b* is surrounded by an annular shield-like dial ring 38 havng a sight opening with an index mark 38*a* at its center. The driving cam 34 is, in typical fashion, threaded onto the threaded rear portion of the spindle 35 projecting rearwardly from the spindle boss 31 and is keyed at the desired angular position by a removable key 40 which is driven into companion kerfs or grooves in the spindle 35 and the confronting wall of the center bore of the driving cam 34. The driving cam has the usual driving pin 34*b* projecting rearwardly therefrom to abut the shoulder on the fly of the forward-most tumbler wheel 27, and has a specially shaped peripheral gate or recess 34*c* to receive the downwardly extending foot portion 41 of the cast fence lever 42 having the relatively along arched leg 43 extending from the pivot pin 44 to the downwardly extending foot formation 41 of the fence lever. The fence lever is an integral cast body of a width adequate to span the whole pack 26 of tumbler wheels 27–30 and also the driving cam 34, and is pivoted at its other end by the pivot pin 44 to the slidable bolt member 45.

In the illustrated embodiment, the bolt member 45 includes a generally rectangular cross-section, rectangular profile block portion 45*a* adapted to project through a rectangular opening 14*a* in the case end wall 14 into a conventional keeper or keeper socket formation fixed on a portion of the safe adjacent the safe door, and includes upper and lower guide shoulder formations 45*b* providing flat surfaces which confront and are closely adjacent the inwardly facing surfaces of the top and bottom walls 15,16 of the case to confine movement of the bolt 45 to rectilinear sliding movement to projected and retracted positions relative to the case along an axis paralleling the horizontal center axis of the lock assembly as viewed in FIG. 2. As will be apparent from FIGS. 1 and 3, the forward-most end of the pivot pin 44 projects beyond the forward-most one of the two apertured mounting ears 43*a* at the end of the fence lever opposite the foot 41 into a U-shaped recess 46*a* of a slide block 46 having a slide surface 46*b* which bears on and slides along the rectilinear shoulder 12*b* of the case front wall 12 during retracting and return movement of the bolt 45. Shoulder formations 15*a* and 16*a* form stop-shoulders in the path of the bolt guide shoulder formations 45*b* to limit retracting movement of the bolt. It will be apparent that the bolt and fence lever assembly and the slide block 46 are such as to permit the lock to be readily adapted for left-hand or right-hand installations, as the fence lever 42 can be pivoted to the bolt either at the root of the upper leg 45*ba* or at the root of the lower leg 45*b* as viewed in FIG. 3, and the slide block 46 may either be located above and sliding on the slide surface 12*b* of the front wall of the case above the horizontal center line as viewed in FIG. 2 or may be below and sliding against the guide surface 12*c* below the horizontal center line.

The tumbler wheel and driving cam contact foot portion 41 of the fence lever 42 includes a contact bar member 48 at the toe or free-end portion of the foot 41, which spans the pack of four tumbler wheels 27, 28, 29 and 30 and the driving cam 34 and normally rides on the outer periphery 34*d* of the driving cam which is cylindrical or circular and of slightly larger diameter than the peripheries of the tumbler wheels 27–30 except for the gate 34*c*. Therefore, only when the tumbler wheel gate 34*b* is aligned with the contact bar member 48, which occurs when, for example, the graduations or dial markings on the periphery of the dial portion 36*b* of the knob and dial member 37 within one or two markings from the zero dial mark are aligned with the index 38*a* of the dial ring and shield member 38.

Figure 5:
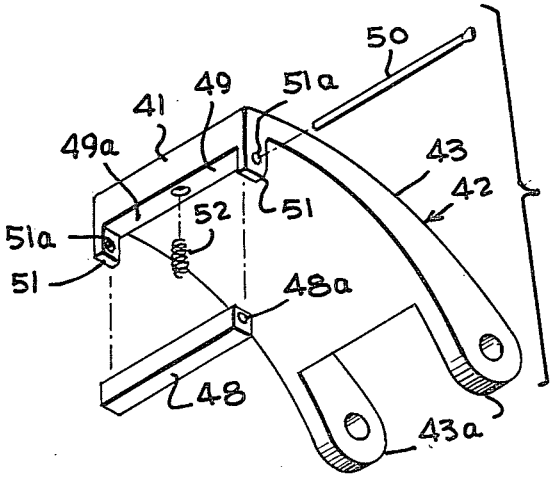
FIG. 5 is a bottom exploded perspective view of the fence lever member, shown to enlarged scale.
Figure 6:
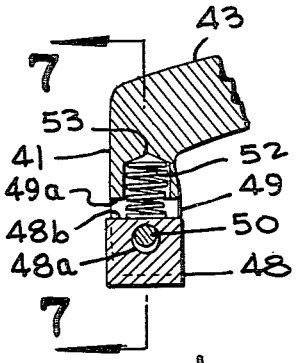
FIG. 6 is a fragmentary vertical section view through the free or foot end portion of the fence lever member, shown to enlarged scale taken along the line 6—6 of FIG. 3.
Figure 7:
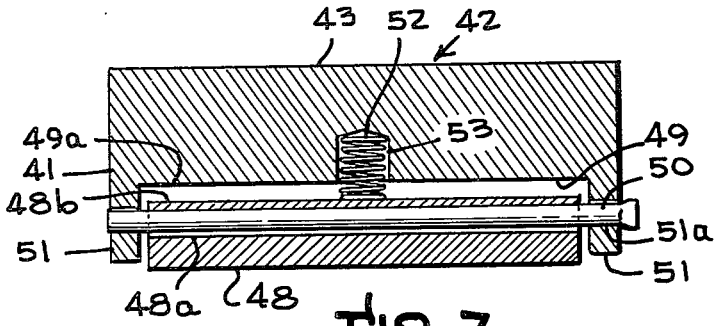
FIG. 7 is a vertical section view taken along the line 7—7 of FIG. 6.

The contact bar member 48, as will be apparent from inspection of FIGS. 3, 5 and 6, is of generally rectangular cross-section, in approximately the form of a square in the illustrated embodiment, which is interfitted into a downwardly opening recess 49 in the toe portion of the contact foot 41 of the fence lever 42 and is pivotally supported by an elongated pivot pin 50 which passes through a somewhat oversize through bore 48*a* in bar 48 and whose opposite ends extend into or through apertures 51*a* in the mounting ears 51 at the opposite sides of the fence lever foot 41 defining the recess 49 for the contact bar member 48. There is a slight tolerance spacing between the confronting inwardly facing edges of the mounting ears 51 and the ends of the contact bar member 48 and also between the contact bar top surface 48*b* of the contact bar member and the base surface 49*a* of the recess 49 adjacent the contact bar top surface 48*b*, permitting a certain amount of tilting movement of the contact bar member about the axis of the pivot pin 50. Additionally, slight random tilting movement of the contact bar member 48 is accentuated by the coil spring 52 compressively seated in the socket 53 about the midpoint of the downwardly facing surface 49*a* of the recess 49 for the contact bar member 48 and bearing against the top surface 48*b* of the bar member to exert random tilting torque forces on the contact bar member 48.

When it is desired to unlock the lock, the dial and knob member 37 is rotated through at least four revolutions in a clockwise direction to bring the dial marking representing the first number of the combination into alignment with the stationary index mark 38*a* on the dial ring 38, then the dial and knob member 37 is rotated in the opposite or counterclockwise direction through three complete revolutions to bring the dial marking representing the second number of the combination into registry with the stationary index mark 38*a*. Thereupon the dial and knob member 37 is rotated again in the clockwise or first direction through two complete revolutions to align the dial marking representing the third combination number with the index 38*a*, after which the dial and knob member are rotated through one complete revolution to align the dial marking representing the fourth combination number with the index mark 38, and the dial is then turned to align the zero marking with the index mark 38. If the proper combination has been dialed, the gates 27*a*–30*a* for the four tumbler wheels will have been properly aligned to receive the foot 41 of the fence lever 42, and upon movement of the dial zero marking to registry with the index mark 38*a*, the gate 34*c* of the drive cam 34 will become aligned with the foot 41 of the fence lever and the fence lever foot will fall into the aligned gates. Further rotation of the dial and knob member 37 to rotate the driving cam 34 in a counterclockwise direction as viewed in FIG. 2 will then cause the downwardly extending foot formation 41 of the fence lever to be engaged by the shoulder portion 34*c*′ of the driving cam gate and cause the fence lever to be drawn to the left, as viewed in FIG. 2, retracting the bolt 45 from its keeper. When the foot portion 41 of the fence 42 drops into the aligned gates of the tumbler wheels and driving cam, the corner of the fence lever where the foot joins the arched leg 43 drops below the ledge or shoulder 15*a* on the top wall 15 of the lock case permitting the fence lever 42 to be drawn to the retracted position by the driving cam gate. Return of the dial and knob member 37 and driving cam gate 34*c* to the zero position, causing the driving cam 34 to rotate in a clockwise direction as viewed in FIG. 2, returns the fence lever 42 and bolt 45 to the projected position, so that when the guide shoulder formations 45*b* reach the lock case wall 14, further projecting movement of the bolt 45 is arrested and the fence lever 42 then rides up to the FIG. 2 position along the concavely curved inclined wall portion 34*c*″ of the driving cam gate.

It will be appreciated that whenever the gate portion 34*c* of the driving cam 34 is moved into registry with the contact foot portion 41 of the fence lever 42 while the tumbler wheels 27–30 are misaligned from the proper combination position, the contact bar member 48 drops against the tumbler peripheries of the tumbler wheels whose gates are not aligned with the fence lever foot portion 41. However, because of the slight tilting member and radial "play" of the contact bar member 48 supported by the pivot pin 50 in the mounting ears 51 of the fence lever foot portion and the random action of the coil spring 52 thereon, the precise amount of decending movement of the fence lever foot portion into the driving cam gate will vary from time to time, substantially confusing the contact point readings which might otherwise be taken measuring the dial readings on the dial 26*b* at the points of contact of the fence lever foot with the shoulder 34*c*′ and inclined surface 34*c*″ of the driving cam gate 34*c* for at various angular positions of the tumber wheel pack. Thus the structure hereinabove described will substantially confuse readings on the wheels and drive cam and significantly resist attempts by unauthorized persons to gain surreptitious entry into the closure secured by the lock.

What is claimed is:

1. In a combination lock for bank vaults, safes and the like, a lock case having a tumbler post therein, a pack of tumbler wheels formed of a plurality of selectively adjustable, peripherally gated tumbler wheels loosely journaled for rotation on said tumbler post about a common axis, a peripherally gated rotatable driving cam fixed on a spindle rotatable about said axis, a manually operable dial and knob member on said spindle for rotating the driving cam to angularly adjust the tumbler wheels to an opening combination for the lock, a bolt slidably supported in said case for movement between projected and retracted positions, means providing a lost motion driving connection between the driving cam and tumbler wheels for adjusting the angular positions of the tumbler wheels, and a fence lever having a pivot connection at one end to the bolt for arcuate movement about the axis of said pivot connection and having an opposite end portion forming a fence end adjacent the peripheries of the driving cam and tumblers, the fence lever being movable arcuately between a raised position locating the fence end outwardly of the peripheries of the driving cam and tumblers and a lower position disposing the fence end in the driving cam gate and tumbler gates when aligned therewith for operatively coupling the driving cam with the fence lever to retract the bolt upon rotation of the driving cam in a predetermined direction; the improvement comprising said fence lever having an upwardly arcuately arching body portion extending from the axis of said pivot connection to a position overlying the pack of tumbler wheels and driving cam and a fence formation extending integrally from said arcuate portion downwardly as a foot formation projecting from the arcuate portion a distance substantially corresponding to the radial depth of the tumbler wheel gates and driving cam gate, and said foot formation having a downwardly facing recess spanning most of the lower end portion thereof and having an elongated unitary contact bar member seated therein extending parallel to said common axis and spanning across the periphery of tumbler wheels and the driving cam to normally bear against the non-gated portion of the driving cam periphery and support the fence lever in said raised position, said contact bar member having a bore extending therethrough parallel to said common axis receiving a supporting pin of slightly smaller diameter than the diameter of said bore and supported in opposite side portions of the fence formation flanking said downwardly opening recess occupied by the contact bar, said contact bar member having a pair of lateral sides and a third side facing the tumbler wheels and driving cam and having a fourth side facing upwardly and spaced slightly from a confronting surface of said recess in said fence formation.

2. A combination lock as defined in claim 1, wherein said bar member is of substantially square cross-section defining four long sides paralleling the axis of the bar supporting pin and said common axis.

3. A combination lock as defined in claim 2, wherein the bar receiving recess in the fence portion of the fence lever extends substantially the full width of the fence lever foot formation along a direction paralleling said common axis and is flanked by thin side portions of the fence lever foot formation at the front and rear thereof providing mounting ears flanking the contact bar member in which opposite ends of the bar supporting pin are fixed.

4. A combination lock as defined in claim 1, wherein said foot formation of said fence lever has a downwardly opening socket therein near the midportion of said contact bar member opening into said bar receiving recess through said confronting surface, the lock including a coil spring nested in said socket in compressed state and bearing downwardly upon said fourth side of said bar member to exert random tilting forces on the bar member about said supporting pin.

5. A combination lock as defined in claim 2, wherein said foot formation of said fence lever has a downwardly opening socket therein near the midportion of said contact bar member opening into said bar receiving recess through said confronting surface, the lock including a coil spring nested in said socket in compressed state and bearing downwardly upon said fourth side of said bar member to exert random tilting forces on the bar member about said supporting pin.

6. A combination lock as defined in claim 3, wherein said foot formation of said fence lever has a downwardly opening socket therein near the midportion of said contact bar member opening into said bar receiving recess through said confronting surface, the lock including a coil spring nested in said socket in compressed state and bearing downwardly upon said fourth side of said bar member to exert random tilting forces on the bar member about said supporting pin.

7. A combination lock as defined in claim 1, wherein each tumbler wheel includes a center hub portion and a peripherally gated outer annular rim portion assembled on the center hub portion, and interlocking lever means releasably interlocking the rim portion with the respective hub portion, and combination change means responsive to insertion and rotation of a combination change key for activating the interlocking levers of the tumbler wheels to release the hub portion to assume different angular positions relative to their companion rim portion when the fence lever is in lowered locking position interposing the foot formation thereof in the tumbler wheel gate to permit resetting of the lock to different opening combination numbers by resetting of relative positions of the hub portions to their companion rim portions.

8. A combination lock as defined in claim 2, wherein each tumbler wheel includes a center hub portion and a peripherally gated outer annular rim portion assembled on the center hub portion, and interlocking lever means releasably interlocking the rim portion with the respective hub portion, and combination change means responsive to insertion and rotation of a combination change key for activating the interlocking levers of the tumbler wheels to release the hub portion to assume different angular positions relative to their companion rim portion when the fence lever is in lowered locking position interposing the foot formation thereof in the tumbler wheel gate to permit resetting of the lock to different opening combination numbers by resetting of relative positions of the hub portions to their companion rim portions.

9. A combination lock as defined in claim 3, wherein each tumbler wheel includes a center hub portion and a peripherally gated outer annular rim portion assembled on the center hub portion, and interlocking lever means releasably interlocking the rim portion with the respective hub portion, and combination change means responsive to insertion and rotation of a combination change key for activating the interlocking levers of the tumbler wheels to release the hub portion to assume different angular positions relative to their companion rim portion when the fence lever is in lowered locking position interposing the foot formation thereof in the tumbler wheel gate to permit resetting of the lock to different opening combination numbers by resetting of relative positions of the hub portions to their companion rim portions.

10. A combination lock as defined in claim 6, wherein each tumbler wheel includes a center hub portion and a peripherally gated outer annular rim portion assembled on the center hub portion, and interlocking lever means releasably interlocking the rim portion with the respective hub portion, and combination change means responsive to insertion and rotation of a combination change key for activating the interlocking levers of the tumbler wheels to release the hub portion to assume different angular positions relative to their companion rim portion when the fence lever is in lowered locking position interposing the foot formation thereof in the tumbler wheel gate to permit resetting of the lock to different opening combination numbers by resetting of relative positions of the hub portions to their companion rim portions.

* * * * *